US009421985B2

(12) United States Patent
Graf et al.

(10) Patent No.: US 9,421,985 B2
(45) Date of Patent: Aug. 23, 2016

(54) RAIL VEHICLE HAVING AN ATTACHED DEFORMATION ZONE

(75) Inventors: Richard Graf, Vienna (AT); Philipp Heinzl, Enzenreith (AT); Markus Seitzberger, Vienna (AT)

(73) Assignee: Siemens AG Oesterreich, Vienna (AT)

( * ) Notice: Subject to any disclaimer, the term of this patent is extended or adjusted under 35 U.S.C. 154(b) by 285 days.

(21) Appl. No.: 14/009,585

(22) PCT Filed: Mar. 26, 2012

(86) PCT No.: PCT/EP2012/055310

§ 371 (c)(1),
(2), (4) Date: Oct. 3, 2013

(87) PCT Pub. No.: WO2012/136500

PCT Pub. Date: Oct. 11, 2012

(65) Prior Publication Data

US 2014/0020596 A1 Jan. 23, 2014

(30) Foreign Application Priority Data

Apr. 4, 2011 (AT) ..... A 476/2011

(51) Int. Cl.
*B61D 15/06* (2006.01)
*B61D 17/06* (2006.01)

(52) U.S. Cl.
CPC ..... *B61D 15/06* (2013.01); *B61D 17/06* (2013.01)

(58) Field of Classification Search
CPC ..... B61D 15/06; B61D 17/06; F16F 7/12; B60R 19/18; B60R 19/34; B61F 1/10; B61G 11/00
USPC ..... 105/392.5
See application file for complete search history.

(56) References Cited

U.S. PATENT DOCUMENTS 5,579,699 A 12/1996 Barjolle
6,286,879 B1 * 9/2001 Haque ..... B60R 19/03 293/102
6,685,040 B2 2/2004 Heinisch et al.

(Continued)

FOREIGN PATENT DOCUMENTS

CN 1463235 A 12/2003
CN 101138981 A 3/2008

(Continued)

OTHER PUBLICATIONS

DE 10 2008 060 715, Aug. 2009, (English translation of the detailed description section).*

*Primary Examiner* — Mark Le
(74) *Attorney, Agent, or Firm* — Laurence Greenberg; Werner Stemer; Ralph Locher

(57) ABSTRACT

A rail vehicle having an attached deformation zone is presented. The rail vehicle has at least one end transverse beam provided in an end face region and corner pillars arranged substantially vertically and extend from the end transverse beam. The deformation zone is provided at the end face having a front transverse beam arranged parallel to the end transverse beam and spaced therefrom in an end-face direction and at least one force transmission element arranged between the end transverse beam and the front transverse beam. The element transmits longitudinal compressive forces between the end transverse beam and the front transverse beam without plastic deformation up to a defined value and failing when the defined value is exceeded.

8 Claims, 9 Drawing Sheets

(56) References Cited

U.S. PATENT DOCUMENTS

| | | | | |
|---|---|---|---|---|
| 7,543,537 | B2 | 6/2009 | Seitzberger et al. | |
| 2004/0040463 | A1 * | 3/2004 | Yamamoto | B61D 15/06 105/396 |
| 2007/0261591 | A1 | 11/2007 | Bravo | |
| 2008/0060544 | A1 | 3/2008 | Kawasaki et al. | |

FOREIGN PATENT DOCUMENTS

| | | | |
|---|---|---|---|
| DE | 195 33 366 | * | 3/1997 |
| DE | 10 2008 060 715 | * | 8/2009 |
| EP | 0655565 | A1 | 5/1995 |
| EP | 1215098 | A1 | 6/2002 |
| EP | 1905661 | A1 | 4/2008 |

* cited by examiner

RAIL VEHICLE HAVING AN ATTACHED DEFORMATION ZONE

CROSS REFERENCE TO RELATED APPLICATIONS

This application is the US National Stage of International Application No. PCT/EP2012/055310 filed Mar. 26, 2012 and claims benefit thereof, the entire content of which is hereby incorporated herein by reference. The International Application claims priority to the Austria application No. A476/2011 filed Apr. 4, 2011, the entire contents of which is hereby incorporated herein by reference.

TECHNICAL FIELD

The invention relates to a rail vehicle having an attached deformation zone.

PRIOR ART

Approval standards for rail vehicles include requirements for evidence of specific strength values of the wagon body. These standards require evidence for example that the rail vehicle can withstand a certain longitudinal force (coupling pressure, buffer pressure, pressure on end transverse beam) without sustaining damage. The UIC-566 standard applicable for Europe requires for example a verifiable coupling pressure of 2000 kN, the standard applicable for the USA demands 3558 kN (800 kip) At the same time, to increase the passive safety of the passengers, there is very often a requirement to guarantee an optimized deformation behavior during a collision.

To this end constructive measures are to be provided which allow the crash energy to be absorbed, so that defined deformable crush zones convert this energy into deformation energy and thereby reduce the stresses for the people in the vehicle.

Likewise the safety zones in the vehicle may not be deformed too greatly, in order to reduce the likelihood of injury for the people in the vehicle, especially also for the drivers located at the front of the train. This is especially of significance for train sets with push locomotives or driven units.

In accordance with the prior art rail vehicles can be easily dimensioned to specific coupling or end transverse beam pressures. Likewise suitable crash modules for accepting the deformation energy are successfully being provided. A combination of the demands for a high static coupling or transverse end beam pressure and for a crash behavior, which can reduce the maximum deceleration of the vehicle and thus the stress on the passengers in the event of a crash has not yet satisfactorily been resolved for the structurally integrated deformation zones.

A further complication in the resolution of this contradictory demand lies in the demand for right-angled wagon ends at the start and end of the train as well, which is especially preferably required in the USA. In such cases the drivers are exposed to particular dangers since construction space for crash elements is only available to a restricted extent. A prior art solution makes provision for embodying the driver's cab in the form of a rigid cell, which is pushed into the inside of the vehicle during a collision. A reduction in the acceleration which acts on the people located in the driver's cab can however not be achieved by this solution. A further difficulty for a construction optimized as regards deformation lies in the mixed-mode operation of passenger and freight traffic even on local transit routes in the USA, so that a plurality of vehicles come into consideration as opposing parties in a collision. This is made more difficult in such cases by freight wagons and especially the locomotives widely used in the USA having practically no energy-dissipating properties. These locomotives must be seen through their massive construction as rigid in practice and also are very likely, because of their greater height, to represent completely incompatible opposing parties for wagons in a collision.

On the one hand the static design and test loads should not lead to a plastic deformation of the components, especially of the crash elements, which necessarily leads to very rigid subframe constructions. On the other hand, in the event of a crash, specific crash elements provided for energy dissipation together with the rigid subframe construction per se should explicitly plastically deform even in a collision with geometrically-incompatible opposing parties in an accident. Opposing collision parties which strike points not designed for a collision are to be seen as geometrically incompatible. For example in a crash displaced vertically upwards in relation to the subframe, as can occur in a collision between a passenger car and a locomotive or a freight wagon. This is only very unsatisfactorily possible with the solutions according to the prior art.

SUMMARY OF THE INVENTION

The underlying object of the invention is therefore to specify a rail vehicle with attached deformation zone, which on the one hand can withstand very high axial pressure forces, on the other hand exhibits a good deformation behavior during accidents especially also with geometrically incompatible opposing parties and is especially designed for embodying vertical wagon ends.

The object is achieved by a rail vehicle with attached deformation zone with the features of claim 1. Advantageous embodiments are the subject matter of subordinate claims.

In accordance with the basic idea behind the invention, a rail vehicle with attached deformation zone is described which comprises at least one end transverse beam provided in a front end face area and corner pillars extending from the end transverse beam disposed essentially at right angles, and wherein a deformation zone is provided on the front end face which has a front transverse beam at a distance in parallel to the end transverse beam in the end face direction and comprises at least one force transmission element, and wherein the at least one force transmission element is arranged between the end transverse beam and the front transverse beam, which transmits longitudinal pressure forces between the end transverse beam and the front transverse beam up to a specific value plastically without deformation and collapses or fails if this specific value is exceeded.

An advantageous development of the inventive rail vehicle comprises transverse pillars which are disposed between the front transverse beam and a corner pillar and which transmit the vertical forces acting on the front transverse beam and direct them into the vehicle structure.

A further development of the invention makes provision for arranging at least one deformation element in the deformation zone so that it does not participate in the transmission of operational loads but becomes effective during a collision after the collapse or failure of the force transmission element and dissipates the kinetic energy of the collision at least partly.

This enables the advantage to be obtained of being able to realize a rail vehicle which is able to safely resist specific longitudinal forces (coupling pressure, buffer pressure, end transverse beam pressure) but on the other hand has an energy-dissipating deformation behavior which minimizes the forces acting on the passengers during a collision.

The force transmission elements and if necessary the transverse pillars of the inventive deformation zone are to be designed so that they have a sufficient strength to enable them to transmit all operational and test forces safely between the front transverse beam and the end transverse beam or the corner pillars respectively. The important property of the force transmission element is that it is dimensioned so that as soon as the safe load is exceeded, this force transmission element collapses or fails so that it no longer presents any significant resistance to further deformation.

This behavior can for example be achieved by the components providing the strength buckling during failure, since a significantly lower force is necessary for buckling deformation than for compressive or tensile deformation. Likewise a similar behavior can also be achieved by components providing strength being connected by a type of connection which fails at a defined overload, e.g. an overlapping connection with rivets which shear at a specific design load. This means that the force transmission element, after its failure, only participates slightly or not at all in the subsequent energy dissipation. This energy dissipation can therefore take place in the deformation elements provided for the purpose.

It is recommended that the force transmission element be designed from an essentially X-shaped arrangement of plates, wherein the force is applied in each case via opposing sides of this X-shaped plate arrangement. It is important that the line of intersection of the plates is disposed at an angle to the force direction since a safe buckling of the plates occurs in such a manner. The arrangement of the line of intersection in the force direction on the other hand would lead to a component for which the force deformation diagram for plastic deformation has a very high force level over the entire deformation path and cannot be used as a force transmission element for the present invention.

If it occurs that a geometrically-incompatible opposing party in an accident first strikes the transverse pillars and the deformation element, the X-shaped arrangement of plates reacts sufficiently sensitively and collapses as a result of the heavily off-center load, which through the plastic deformation of the transverse pillars assumed to follow thereafter also has a rather deformation-driven character, so that also in such a case the force transmission element only participates at an extremely low level in the energy dissipation.

An embodiment of the force transmission element makes provision for the individual plates which form the essentially X-shaped force transmission element to be embodied with different thicknesses in each case. This enables the advantage to be achieved of being able to precisely set the failure load and the direction of the buckling of the plates. Such an arrangement can be well designed with computer-aided simulation in relation to its strength (failure load) and also its plastic deformation behavior.

It is further recommended that one plate of this X-shaped arrangement is designed in one piece and with a greater thickness than the two other plates. This enables the failure load to be set more precisely.

It is further advantageous to assemble this X-shaped arrangement of plates from a number of plates, especially from three plates. In such a way the failure load and the buckling behavior can be set especially precisely.

It is recommended that the plates be connected at the line of intersection of the plates, wherein a welded connection is especially advantageous.

As a further advantageous embodiment it is also possible to design the force transmission element as a combined force transmission and energy absorption element which, if a defined failure load is exceeded, dissipates energy through deformation.

This can be done in a number of ways which correspond to the state-of-the-art in rail vehicle construction. Tubular crash elements should be mentioned here as possible actual forms of design, which progressively buckle when a peak force is exceeded. Strength-providing components held in a force fit, which, if a release forces exceeded our processed in a tensile manner by the force fit and also tube-shaped crash elements which are widened, narrowed or peeled off after a release force is exceeded.

The invention presented here succeeds in specifying a rail vehicle with a deformation zone of which the strength is able to be designed for static loads and the crash resistance for accident loads (with large plastic deformations) practically and essentially separately and which is also suitable for collisions with geometrically-incompatible opposing accident parties and especially also for vehicles with vertical wagon ends with a door opening. An inventive deformation zone can however in principle be provided on all widely-used rail vehicle types. Locomotives and freight wagons are especially seen as geometrically-incompatible opposing parties in accidents.

All widely-used deformation elements can be used as the deformation element, especially those comprising tubular profiles. Likewise deformation elements made from an aluminum honeycomb construction or made from a metal foam can be used.

The present invention is especially well suited to rail vehicles which are to be approved in the USA, since the relevant standards make provision for the application of the longitudinal test forces via the end transverse beams and thus no deformation elements attached to the wagon end can be provided, since these could not withstand the test forces.

BRIEF DESCRIPTION OF THE DRAWINGS

The drawings show the following by way of example.

EMBODIMENT OF THE INVENTION

Figure 1:
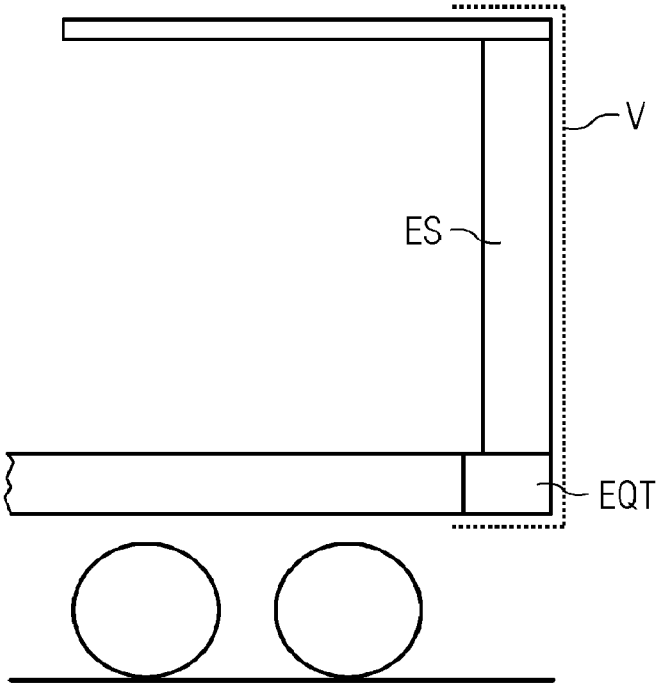
FIG 1 Prior art
FIG. 1 a rail vehicle with a vertical wagon end in accordance with the prior art—side view.

FIG. 1 shows an example in a schematic diagram of a rail vehicle with vertical wagon ends in accordance with the prior art in a side view. A vehicle end of a rail vehicle is shown having an end transverse beam EQT at its end.

Longitudinal forces act on this end transverse beam EQT, this end transverse beam EQT is correspondingly dimensioned for this purpose with attachment means for excepting buffers, couplings, etc.

Corner pillars ES are provided perpendicular to this end transverse beam EQT, which extend from the end transverse beam EQT to the roof of the rail vehicle.

The paneling V essentially serves the usual protection and design purposes and does not have any strength relevant during a collision. A rail vehicle in accordance with FIG. 1 has no significant energy-dissipating properties, in a collision high forces act on the passengers.

Figure 2:
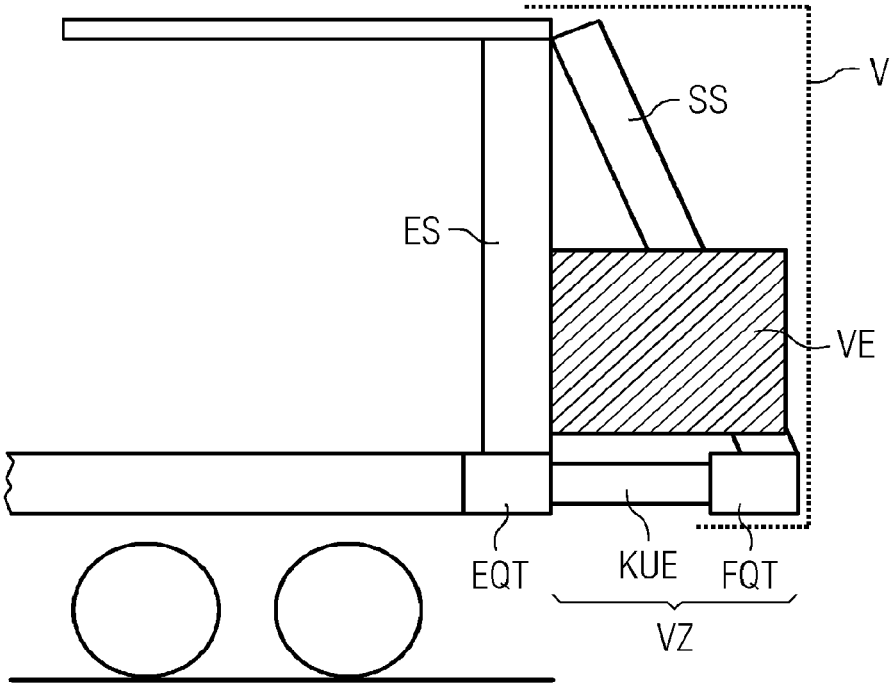
FIG. 2 a rail vehicle with attached deformation zone—side view.

FIG. 2 shows an example in a schematic diagram of a rail vehicle with attached deformation zone in a side view. In principle an inventive deformation zone is shown, wherein the rail vehicle is constructed in accordance with the prior art, as in the example shown in FIG. 1. The inventive deformation zone VZ is attached to the rail vehicle on its end face side and comprises a force transmission element KUE, which is disposed between an end transverse beam EQT and a front transverse beam FQT in parallel to the end transverse beam EQT at a distance from it in the direction of the end of the wagon. Transverse pillars SS are also provided, which connect the front transverse beam to a corner pillar ES. These components of the deformation zone VZ (front transverse beam FQT, force transmission element KUE and transverse pillars SS) are designed or dimensioned so that these transmit all operational and test forces safely between the end transverse beam EQT or the corner pillars ES or collision pillars KS and the front transverse beam FQT.

Figure 6:
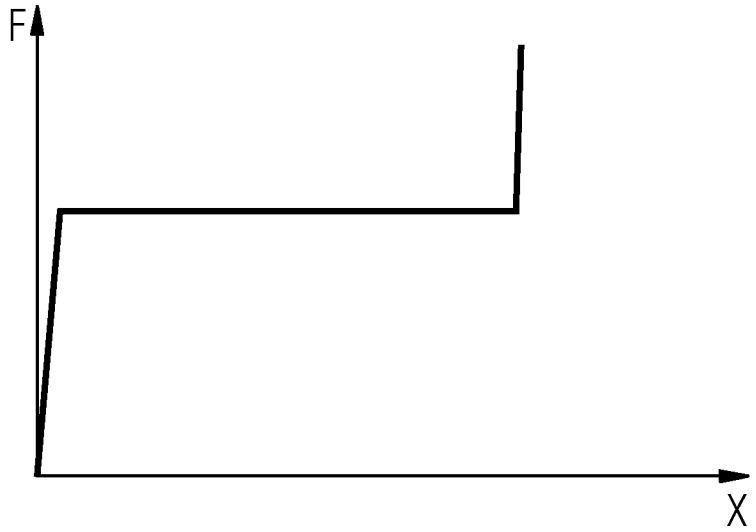
FIG. 6 an idealized force deformation diagram of a deformation element.
Figure 7:
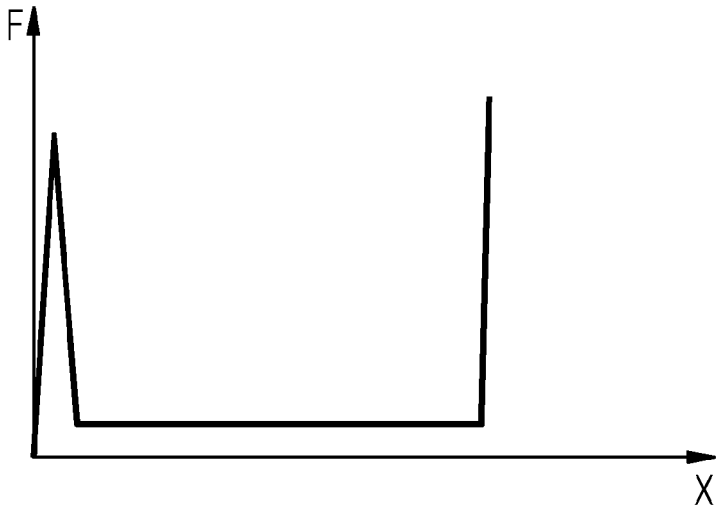
FIG. 7 an idealized force deformation diagram of a force transmission element.

A transverse pillar SS can also comprise vertical sections. When subjected to a load, the force transmission element KUE has a force deformation diagram as shown in FIG. 7. The deformation zone VZ also comprises deformation elements VE which are disposed on the end face side on the corner pillars ES and which, when subjected to a load, have a force deformation diagram as shown by way of example in FIG. 6, are thus suitable for energy dissipation in the case of plastic deformation. These deformation elements VE are disposed so that they do not participate in the transmission of static loads and only come into effect after the collapse or failure of the force transmission element KUE. The deformation elements VE also come into effect during a collision with a geometrically-incompatible opposing collision party.

Figure 3:
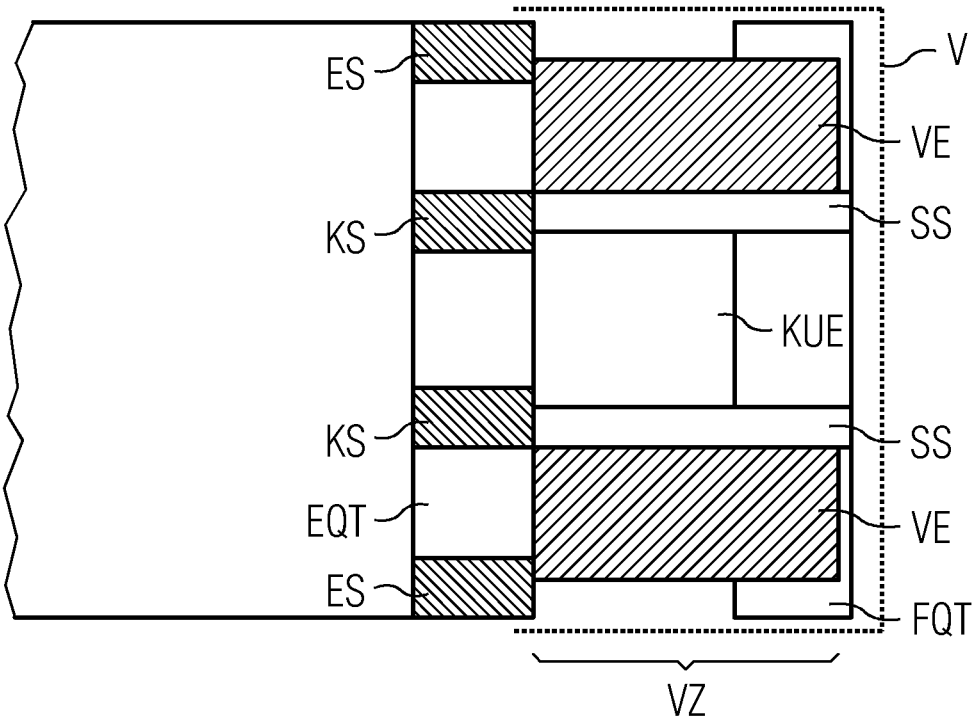
FIG. 3 a rail vehicle with attached deformation zone—view from above.

FIG. 3 shows an example in a schematic diagram of a rail vehicle with attached deformation zone in a view from above with a force transmission element. The rail vehicle from FIG. 2 is shown. In this exemplary embodiment four pillars disposed vertically, connected to the end transverse beam EQT are provided. Two of these four pillars, the corner pillars ES, are disposed on the wagon outer side of the end transverse beam EQT, two further pillars, the collision pillars KS, are disposed spaced away from the corner pillars ES in the direction towards the center of the wagon. The transverse pillars SS extend between the front transverse beam FQT and a collision pillar KS in each case. Such a construction corresponds to the vehicle type frequently required in the USA, a central passage between the two transverse pillars SS is easy to realize. Likewise the space behind the end transverse beam EQT, especially between a corner pillar ES and a collision pillar KS, is especially well suited for the arrangement of a collision-protected driver's cab. Depending on the desired vehicle shape, the paneling V can form angled, rounded or vertical vehicle ends.

Figure 4:
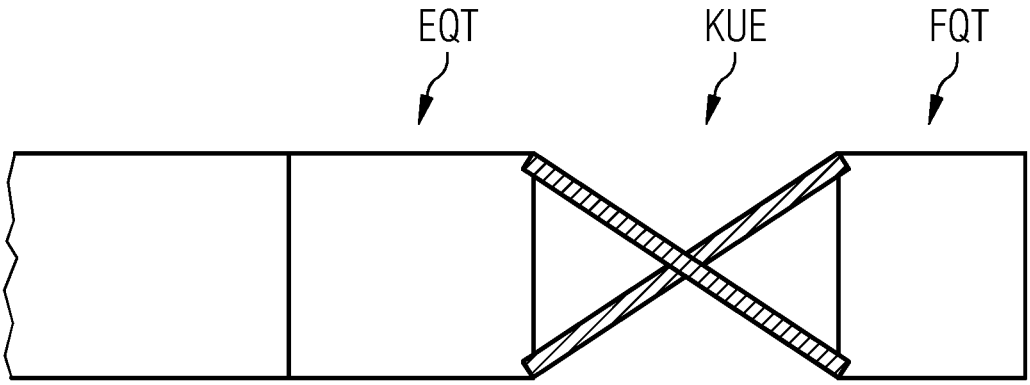
FIG. 4 a force transmission element in a side view.

FIG. 4 shows an example in a schematic diagram of a force transmission element in a side view.

A force transmission element KUE is shown which connects an end transverse beam EQT with a front transverse beam FQT.

This force transmission element KUE has a force deformation relationship as is shown in FIG. 7. To achieve such a force deformation relationship it is especially advantageous to construct the force transmission element KUE from plates diposed in an X shape and to arrange the line of intersection of the plates of the force transmission element KUE disposed in an X shape transverse to the longitudinal direction of the vehicle. Through this arrangement it is easily possible to calculate the failure load and this arrangement only presents a very small resistance to further deformation after the collapse when the failure load is exceeded.

Figure 5:
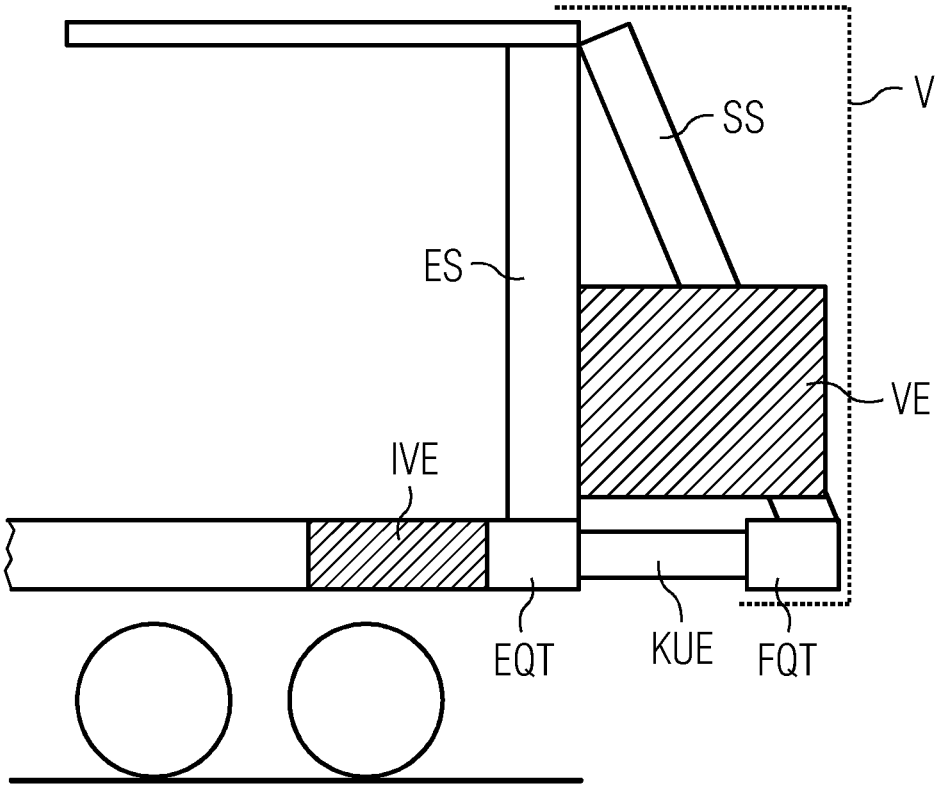
FIG. 5 a rail vehicle with attached deformation zone and inner deformation element—side view.

FIG. 5 shows an example of a schematic diagram of a rail vehicle with attached deformation zone and inner deformation element in a side view.

A development of an inventive rail vehicle with attached deformation zone VZ, as in FIGS. 2 and 3, is shown. An inner deformation element IVE is disposed in the center of the wagon of an end transverse beam and supports the advantageous deformation behavior of the inventive rail vehicle. This inner deformation element IVE is dimensioned so that it only comes into effect after the failure of the force transmission element KUE and after the deformation element VE is used up. Likewise the inner deformation element IVE improves the deformation behavior of the rail vehicle during collisions with geometrically-incompatible opposing collision parties, especially in a collision with flat freight wagons in which the deformation element VE in extreme cases is only deformed late or is not deformed at all.

FIG. 6 shows an example in a schematic diagram of an idealized force deformation diagram of a deformation element. An idealized force deformation diagram of a typical deformation element VE during plastic deformation is shown. The horizontal axis represents the deformation distance x, the vertical axis represents the force F acting on the deformation element VE. The curve of the force F shows a sharply rising section and a subsequent horizontal section on further deformation. The area of this horizontal section, in which a further deformation x occurs at constant force F, represents the area of significance for the energy dissipation. If the constructively predetermined maximum deformation distance is used up, the deformation element VE is thus completely squashed, a very steep force increase occurs and the deformation element VE no longer has any significant energy-dissipating effect.

FIG. 7 shows an example in a schematic diagram of an idealized force deformation diagram of a force transmission element. A force deformation diagram of a typical force transmission element KUE on plastic deformation or instability is shown. The horizontal axis represents the deformation distance x, the vertical axis represents the force F acting on the force transmission element KUE. By contrast with the force deformation diagram of a deformation element VE shown in FIG. 6, the force deformation curve of a force transmission element KUE, after a steep force increase during initial deformation up to a maximum value of the force F, does not show any subsequent horizontal force curve. The significant property of a force transmission element KUE, on the one hand of being able to safely transmit a specific maximum force, but of failing when this maximum force is exceeded (if necessary increased by a specific safety factor) and no longer presenting any significant resistance to further deformation, is shown in FIG. 7. After a specific maximum force F has been exceeded a further deformation occurs at a significantly lower force level, practically negligible in relation to the maximum force F. Only when the constructively predetermined maximum deformation distance is used up, the force transmission element KUE is thus completely crushed, does a very steep force increase occur.

Figure 8:
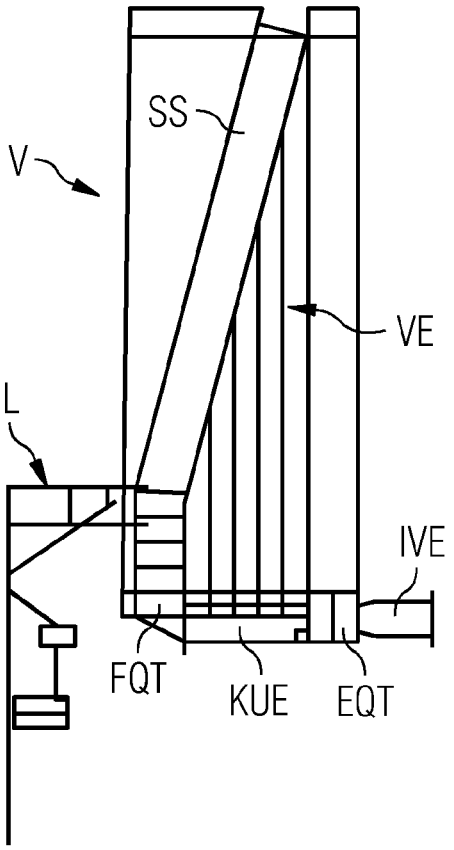
FIG. 8 a computer-simulated collision—side view 1.

FIG. 8 shows a computer-simulated collision in a side view, stage 1—undeformed.

A simulation of the collision of a rail vehicle with attached deformation zone, as shown in FIG. 5, with a locomotive L is shown. A locomotive L represents a massive, essentially undeformable and geometrically-incompatible opposing collision party. The transverse pillars SS have vertical sections. The locomotive L strikes a point above the front transverse beam FQT, so that the plastic deformation begins at this point. This exemplary embodiment shows a different force transmission element KUE from that shown in FIG. 4.

Figure 9:
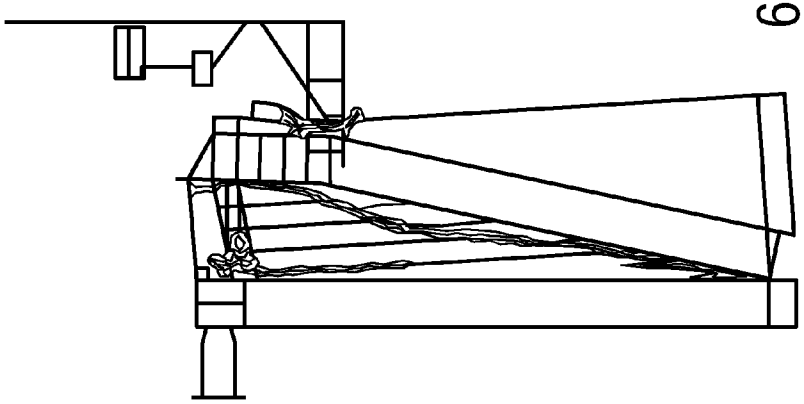
FIG. 9 a computer-simulated collision—side view 2.

FIG. 9 shows a computer-simulated collision in a side view, stage 2—first deformations. To clarify the sequences of the deformation process all reference characters are omitted in FIGS. 9 to 12. The paneling V does not present any perceptible resistance to a deformation and is already destroyed at this small deformation distance. The transverse pillars SS are partly straightened by the introduction of the force at the point of contact with the locomotive L, the deformation elements VE exhibit first deformations and dissipate the deformation energy. The force transmission elements KUE still have a stable shape.

Figure 10:
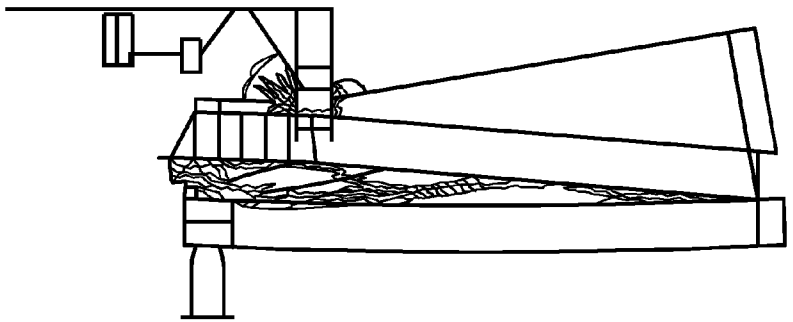
FIG. 10 a computer-simulated collision—side view 3.

FIG. 10 shows a computer-simulated collision in a side view, stage 3—strong deformations. Through the ongoing deformation the transverse pillars SS are straightened out and the deformation elements VE lying behind them almost compressed. In this deformation stage the force transmission elements KUE have already collapsed, first deformations of the corner pillars ES are showing.

Figure 11:
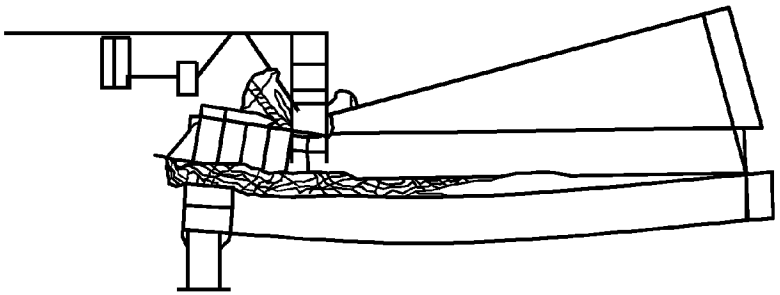
FIG. 11 a computer-simulated collision—side view 4.

FIG. 11 shows a computer-simulated collision in a side view, stage 4—very strong deformations. The deformation elements VE are completely used up, strong deformations of the corner pillars ES are forming.

Figure 12:
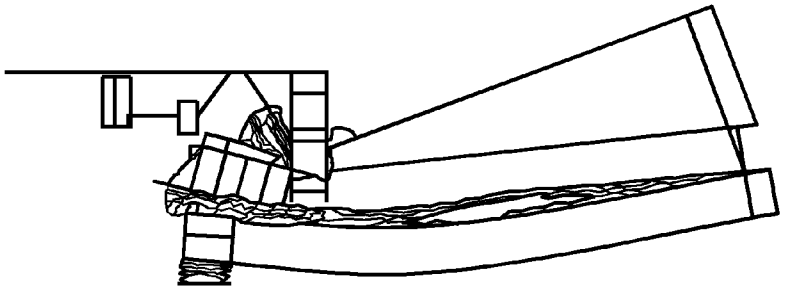
FIG. 12 a computer-simulated collision—side view 5.

FIG. 12 shows a computer-simulated collision in a side view, stage 5—extreme deformations. At this stage the corner pillars are heavily bent in the direction towards the inside of the wagon, the inner deformation element has responded and is used up.

Figure 13:
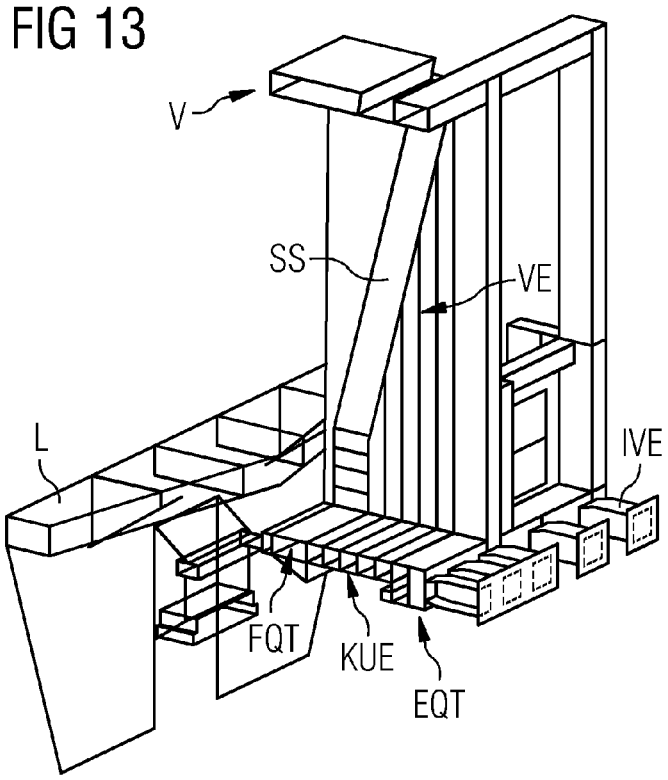
FIG. 13 a computer-simulated collision—oblique view 1.

FIG. 13 shows a computer-simulated collision in an oblique view, stage 1—undeformed. The scenario from FIG. 8 is shown in an oblique view and cut in the longitudinal direction in the center.

Figure 14:
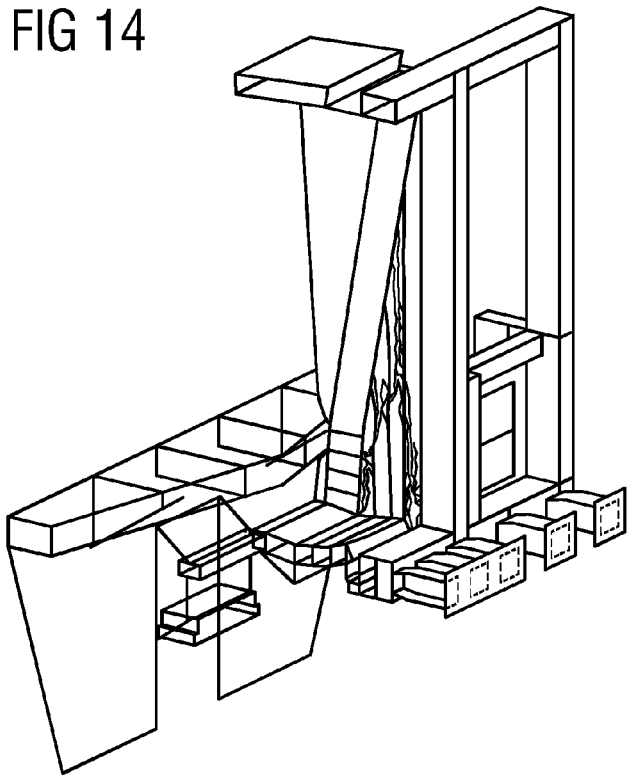
FIG. 14 a computer-simulated collision—oblique view 2.

FIG. 14 shows a computer-simulated collision in an oblique view, stage 2—first deformations. Oblique view of the scenario shown in FIG. 9.

Figure 15:
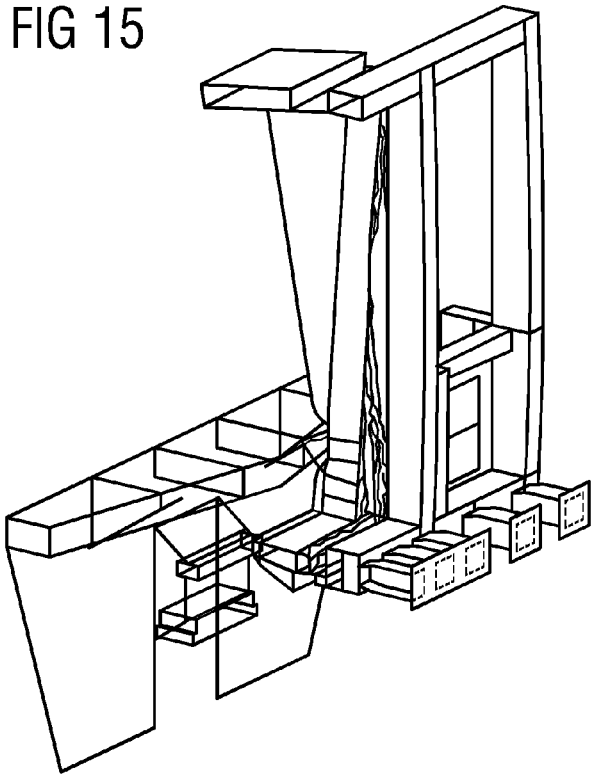
FIG. 15 a computer-simulated collision—oblique view 3.

FIG. 15 shows a computer-simulated collision in an oblique view, stage 3—strong deformations. Oblique view of the scenario shown in FIG. 10.

Figure 16:
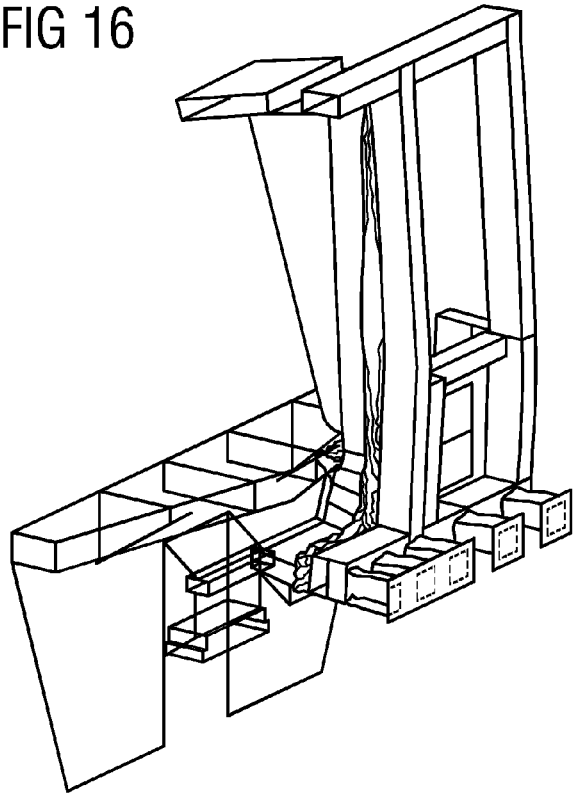
FIG. 16 a computer-simulated collision—oblique view 4.

FIG. 16 shows a computer-simulated collision in an oblique view, stage 4—very strong deformations. Oblique view of the scenario shown in FIG. 11.

Figure 17:
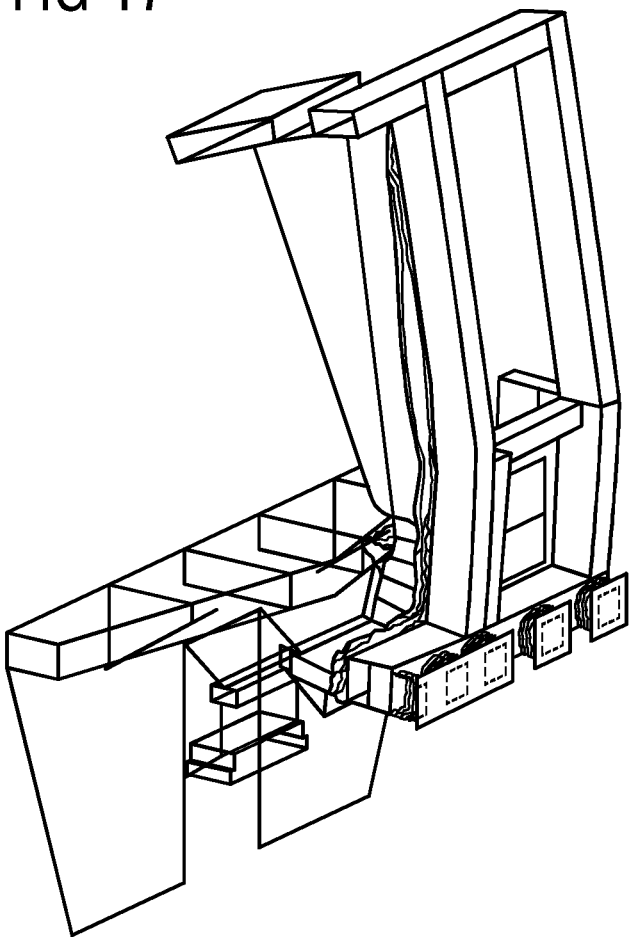
FIG. 17 a computer-simulated collision—oblique view 5.

FIG. 17 shows a computer-simulated collision in an oblique view, stage 5—extreme deformations. oblique view of the scenario shown in FIG. 12.

LIST OF REFERENCE CHARACTERS

EQT End transverse beam
ES Corner pillar
V Paneling
VZ Deformation zone
FQT Front transverse beam
SS Transverse pillar
VE Deformation element
KUE Force transmission element
KS Collision pillar
IVE Inner deformation element
F Force
x Deformation distance
L Locomotive

The invention claimed is:

1. A rail vehicle, comprising:

a deformation zone provided on an end face side, said deformation zone having:

at least one end transverse beam provided in an end face area, end pillars arranged substantially vertically extending from the end transverse beam, a front transverse beam disposed in parallel to the end transverse beam spaced away from the end transverse beam in an end face direction, at least one force transmission element disposed between the end transverse beam and the front transverse beam, wherein the force transmission element transmits longitudinal pressure forces between the end transverse beam and the front transverse beam up to a specific value plastically without deformation and fails when the specific value is exceeded, wherein the force transmission element is constructed from plates arranged in an X shape, wherein an intersection line of the plates arranged in the X shape of the force transmission element is disposed transverse to a longitudinal direction of the vehicle; and the deformation zone further including at least one deformation element so that a deformation of the at least one deformation element only occurs after the failure of the force transmission element.

2. The rail vehicle as claimed in claim 1, wherein the at least one deformation element comprises an aluminum honeycomb construction, or a metal foam, or a tubular profile.

3. The rail vehicle as claimed in claim 1, wherein at least one transverse pillar is disposed between the front transverse beam and a corner pillar.

4. The rail vehicle as claimed in claim 1, wherein a subframe of the rail vehicle between a center of a wagon and the end transverse beam comprises at least one inner deformation element.

5. The rail vehicle as claimed in claim 4, wherein the at least one inner deformation element comprises an aluminum honeycomb construction, or a metal foam, or a tubular profile.

6. The rail vehicle as claimed in claim 1, wherein the deformation zone comprises paneling that covers components of the deformation zone.

7. The rail vehicle as claimed in claim 6, wherein the paneling is made from a plastic.

8. The rail vehicle as claimed in claim 1, wherein the deformation zone is provided at both end face sides of the rail vehicle.

* * * * *